US008421576B2

(12) United States Patent
Iwasaki

(10) Patent No.: US 8,421,576 B2
(45) Date of Patent: Apr. 16, 2013

(54) ELECTRONIC COMPONENT AND MANUFACTURING METHOD OF THE SAME

(75) Inventor: Keisuke Iwasaki, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 136 days.

(21) Appl. No.: 12/985,756

(22) Filed: Jan. 6, 2011

(65) Prior Publication Data

US 2011/0193671 A1 Aug. 11, 2011

(30) Foreign Application Priority Data

Feb. 8, 2010 (JP) ..... 2010-025384

(51) Int. Cl.
*H01F 5/00* (2006.01)

(52) U.S. Cl.
USPC ..... 336/200

(58) Field of Classification Search ..... 336/65, 336/83, 200, 206–208, 232
See application file for complete search history.

(56) References Cited

U.S. PATENT DOCUMENTS

| | | | | |
|---|---|---|---|---|
| 2012/0032767 | A1* | 2/2012 | Iwasaki et al. | 336/200 |
| 2012/0062348 | A1* | 3/2012 | Hashimoto | 336/192 |

FOREIGN PATENT DOCUMENTS

| | | | |
|---|---|---|---|
| JP | H6-84639 | A | 3/1994 |
| JP | 11-121252 | | 4/1999 |
| JP | 2000-133521 | A | 5/2000 |
| JP | 2001-313212 | A | 11/2001 |
| JP | 2002-134323 | A | 5/2002 |
| JP | 2006-310475 | A | 11/2006 |

OTHER PUBLICATIONS

The Korean Office Action dated Dec. 20, 2011; Korean Patent Application No. 2010-0118555 with abstract.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

An electronic component and manufacturing method are provided that allow an increase in a size of a circuit element included therein and suppression of a short-circuit-preventing insulator film from easily peeling off from a laminated body. The laminated body includes a plurality of insulator layers laminated on one another. The laminated body has an upper face and a lower face opposing each other in a z-axis direction and lateral faces connecting the upper face to the lower face. The insulator film is provided on the lateral faces. A circuit element such as a coil is included in the laminated body and has a part protruding from the lateral faces of the laminated body toward the insulator film.

13 Claims, 5 Drawing Sheets

ELECTRONIC COMPONENT AND MANUFACTURING METHOD OF THE SAME

CROSS REFERENCE TO RELATED APPLICATIONS

The present application claims priority to Japanese Patent Application No. 2010-025384 filed Feb. 8, 2010, the entire contents of which are incorporated herein by reference in their entirety.

FIELD OF THE INVENTION

The present invention relates generally to electronic components and, more particularly, to an electronic component including a laminated body containing a circuit element therein.

BACKGROUND

A multilayer coil disclosed in Japanese Unexamined Patent Application Publication No. 2000-133521 is known as one kind of electronic components according to the related art. The multilayer coil disclosed in Japanese Unexamined Patent Application Publication No. 2000-133521 will be described below. FIG. 5 is a sectional view illustrating a configuration of a multilayer coil 500 disclosed in Japanese Unexamined Patent Application Publication No. 2000-133521.

As illustrated in FIG. 5, the multilayer coil 500 includes a laminated body 512, outer electrodes 514*a* and 514*b*, an insulating resin 518, and a coil L. The substantially rectangular-parallelepiped laminated body 512 includes a plurality of insulating sheets laminated on one another. The helical coil L, included in the laminated body 512, includes a plurality of connected coil conductor patterns 516. As illustrated in FIG. 5, the coil conductor patterns 516 are exposed from lateral faces of the laminated body 512.

The outer electrodes 514*a* and 514*b* on upper and lower faces of the laminated body 512, respectively, are connected to the coil L. The insulating resin 518 is provided on the lateral faces of the laminated body 512 to cover parts of the coil conductor patterns 516 exposed from the lateral faces of the laminated body 512.

Since the coil conductor patterns 516 extend to outer peripheries of the corresponding insulating sheets in the multilayer coil 500 having the foregoing configuration, an inside diameter of the coil L can be increased. Furthermore, since the insulating resin 518 covers the lateral faces of the laminated body 512 in the multilayer coil 500, a short circuit between the coil conductor patterns 516 and patterns on a circuit board is prevented.

However, in the multilayer coil 500 disclosed in Japanese Unexamined Patent Application Publication No. 2000-133521, the insulating resin 518 relatively easily peels off from the laminated body 512. More specifically, the laminated body 512 is formed of a magnetic material, such as ferrite, whereas the insulating resin 518 is formed of a material, such as an epoxy resin. Because the laminated body 512 and the insulating resin 518 are formed of different materials, adhesion between the laminated body 512 and the insulating resin 518 in the multilayer coil 500 is relatively low. Thus, the insulating resin 518 may unfortunately peel off from the laminated body 512.

SUMMARY

The inventions are directed to an electronic component and a method of manufacturing an electronic component.

In an embodiment consistent with the claimed invention, an electronic component includes a laminated body including a plurality of insulator layers laminated on one another and having an upper face and a lower face opposing each other in a lamination direction and lateral faces connecting the upper face to the lower face. An insulator film is provided on the lateral faces. A circuit element is included in the laminated body and has a part protruding from the lateral faces of the laminated body toward the insulator film.

In another embodiment consistent with the claimed invention, a method of manufacturing an electronic component includes providing a conductive layer pattern on one side of at least one of a plurality of insulating layers. The insulating layers have a firing shrinking ratio greater than a firing shrinking ratio of said conductive layer pattern. The plurality of insulating layers are stacked in a stacking direction to form an unfired laminated body. The unfired laminated body is thereafter fired, which causes a portion of each conductive layer to protrude from lateral sides of the insulating layers in a direction perpendicular from the stacking direction. Electrodes are formed on opposing ends of the laminated body in the stacking direction, and an insulator film is formed on the lateral sides of the laminated body and the protruding portions.

In other aspects of the invention, the size of the circuit element formed inside the electronic component can be increased and peeling off of the short-circuit-preventing insulator film from the laminated body can be suppressed.

Other features, elements, characteristics and advantages of the present invention will become more apparent from the following detailed description of preferred embodiments of the present invention with reference to the attached drawings.

DETAILED DESCRIPTION

Figure 1:
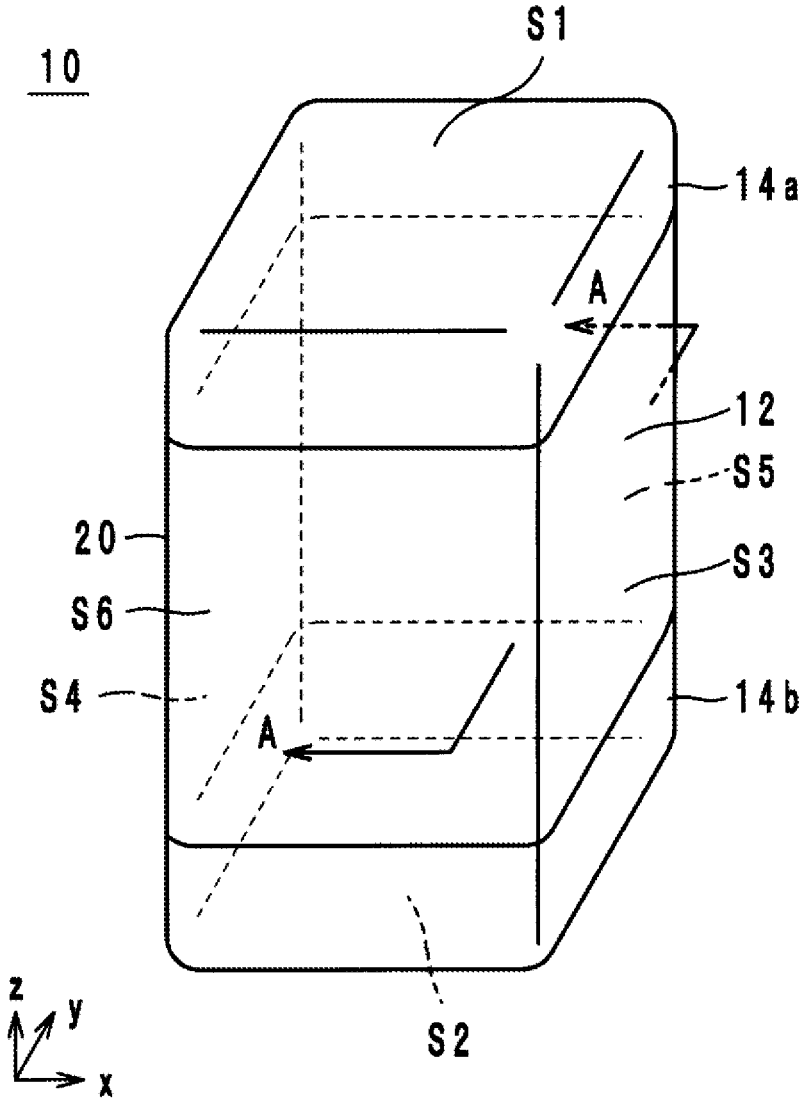
FIG. 1 is a perspective view of an appearance of an electronic component according to an exemplary embodiment of the present invention.
Figure 2:
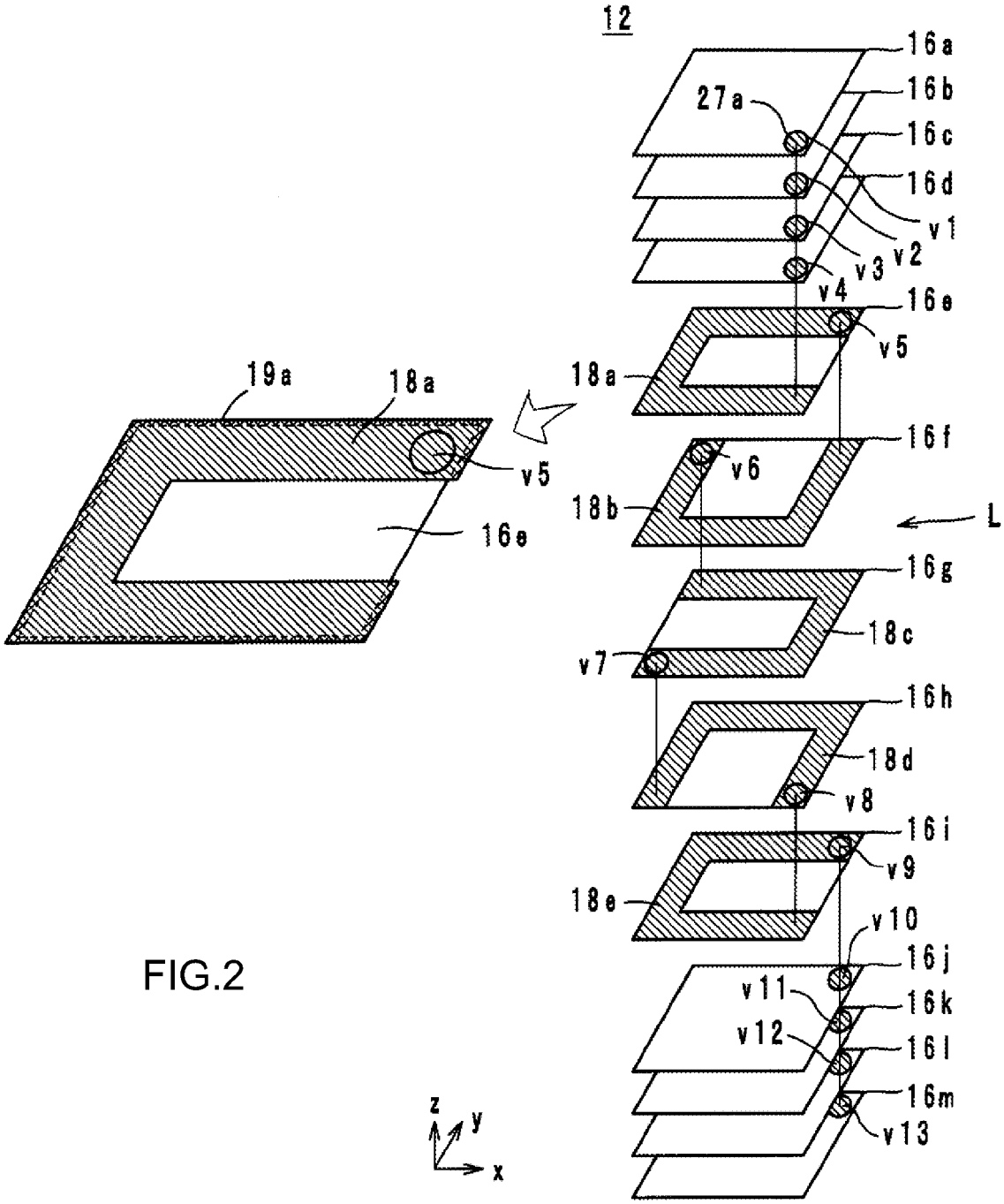
FIG. 2 is an exploded perspective view of a laminated body of the electronic component according to the exemplary embodiment shown in FIG. 1.
Figure 3:
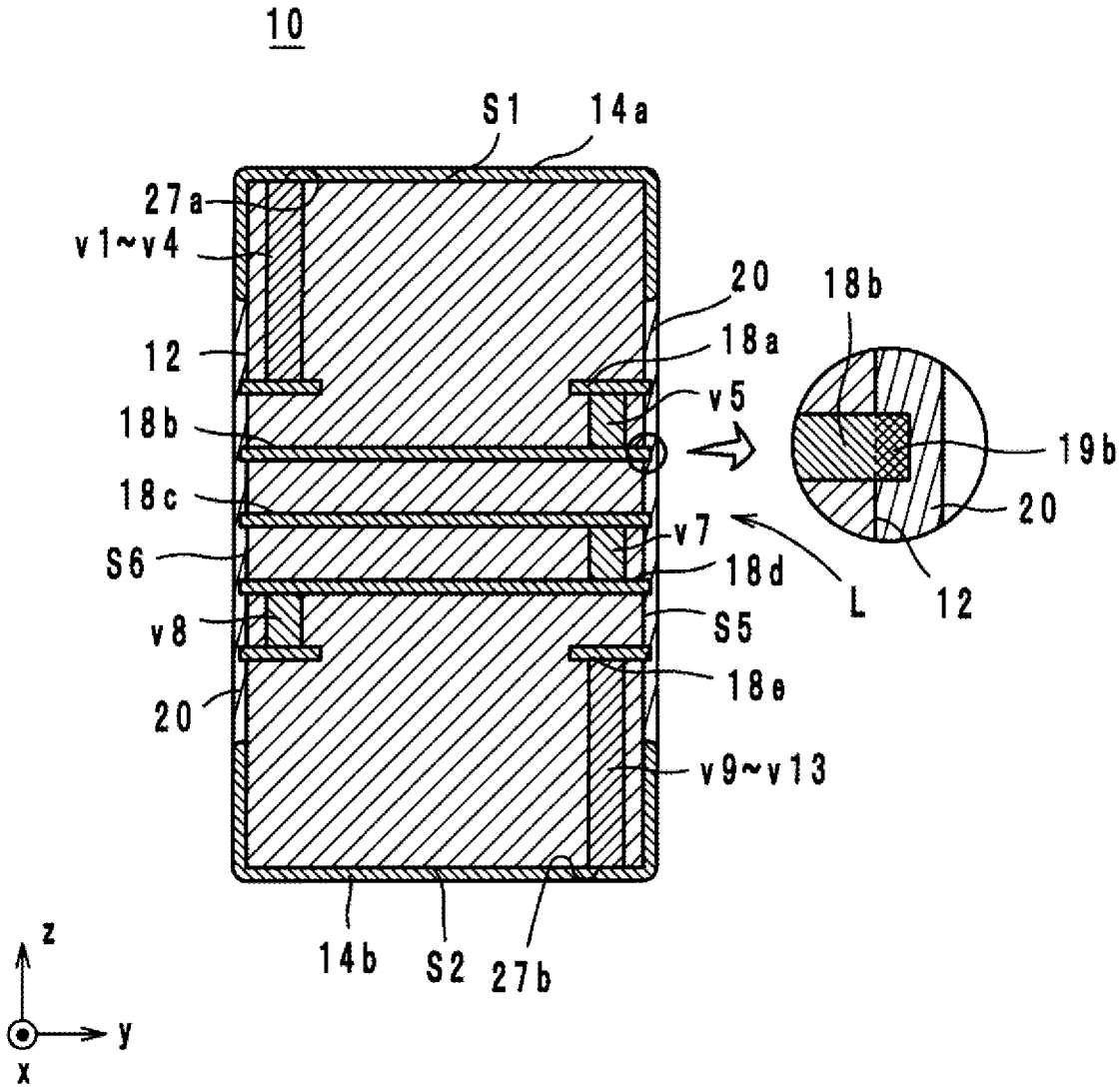
FIG. 3 is a configuration-illustrating sectional view taken along line A-A of the exemplary electronic component illustrated in FIG. 1.

An electronic component according to an exemplary embodiment will now be described with reference to FIGS. 1 to 3. FIG. 1 is a perspective view of an appearance of an electronic component 10. FIG. 2 is an exploded perspective view of a laminated body 12 of the electronic component 10 according to the exemplary embodiment. FIG. 3 is a configuration-illustrating sectional view taken along line A-A of the electronic component 10 illustrated in FIG. 1.

Hereinafter, a lamination direction of the electronic component 10 is defined as a z-axis direction, whereas directions along two sides of a face (hereinafter, referred to as an upper face S1) of the electronic component 10 in a positive z-axis direction are defined as x-axis and y-axis directions, respectively. The x-axis, y-axis, and z-axis directions are orthogonal to each other. A face of the electronic component 10 in a negative z-axis direction is referred to as a lower face S2. The lower face S2 opposes the upper face S1 in the z-axis direction. Furthermore, faces of the electronic component 10 connecting the upper face S1 to the lower face S2 are referred to as lateral faces S3-S6. The lateral face S3 is located on a positive side of the x-axis direction, whereas the lateral face S4 is located towards a negative side of the x-axis direction. The lateral face S5 is located on a positive side of the y-axis direction, whereas the lateral face S6 is located towards a negative side of the y-axis direction.

As illustrated in FIGS. 1 and 2, the electronic component 10 includes the laminated body 12, outer electrodes 14 (i.e., 14*a* and 14*b*), an insulator film 20, and a coil (i.e., an electronic element) L, not illustrated in FIG. 1. The substantially rectangular-parallelepiped laminated body 12 includes the coil L therein.

The outer electrodes 14*a* and 14*b* are disposed, or provided on the upper face S1 and the lower face S2 of the laminated body 12, respectively. The outer electrodes 14*a* and 14*b* are folded from the upper face S1 and the lower face S2, respectively, toward the lateral faces S3-S6.

As illustrated in FIG. 2, insulator layers 16 (i.e., 16*a*-16*m*) are laminated in this order from the positive z-axis direction to the negative z-axis direction to constitute the laminated body 12. The substantially rectangular insulator layers 16 can be formed of a magnetic material (e.g., Ni—Cu—Zn ferrite). "Magnetic material," as used herein, indicates a material functioning as a magnetic material in a temperature range from −55° C. to +125° C. Hereinafter, faces of the insulator layers 16 in the positive z-axis direction are referred to as front faces, whereas faces of the insulator layers 16 in the negative z-axis direction are referred to as back faces.

As illustrated in FIG. 1, the insulator film 20 covers parts of the lateral faces S3-S6 of the laminated body 12 without the outer electrodes 14*a* and 14*b*. The insulator film 20 is formed of a material different from the magnetic material of the laminated body 12. For example, the insulator film 20 can be formed of an epoxy resin.

The coil L is included in the laminated body 12. As illustrated in FIG. 2, coil conductor layers 18 (i.e., 18*a*-18*e*) and via hole conductors v1-v13 constitute the coil L. More specifically, the coil conductor layers 18*a*-18*e* and the via hole conductors v1-v13 are connected to each other to constitute the substantially helical coil L. The coil L has an axis parallel to the z-axis direction.

As illustrated in FIG. 2, the coil conductor layers 18*a*-18*e* are substantially U-shaped line conductor layers disposed (provided) on the front faces of the insulator layers 16*e*-16*i*, respectively. The coil conductor layers 18*a*-18*e* swirl and partially protrude from outer peripheries of the insulator layers 16*e*-16*i*, respectively. More specifically, the coil conductor layers 18*a*-18*e* each having a ¾ turn are disposed, or provided along three sides of the insulator layers 16*e*-16*i* to protrude from the three sides, respectively. The coil conductor layers 18*a*-18*e* also protrude from both ends of the other side. More specifically, the coil conductor layer 18*a* is provided along the three sides of the insulator layer 16*e* other than one in the positive x-axis direction and has a protruding part 19*a* protruding from the three sides. The protruding part 19*a* also protrudes from the both ends of the side in the positive x-axis direction. The coil conductor layer 18*b* is provided along the three sides of the insulator layer 16*f* other than one in the positive y-axis direction and has a protruding part 19*b* (not illustrated in FIG. 2) protruding from the three sides. The protruding part 19*b* also protrudes from the both ends of the side in the positive y-axis direction. The coil conductor layer 18*c* is provided along the three sides of the insulator layer 16*g* other than one in the negative x-axis direction and has a protruding part 19*c* (not illustrated in FIG. 2) protruding from the three sides. The protruding part 19*c* also protrudes from the both ends of the side in the negative x-axis direction. The coil conductor layer 18*d* is provided along the three sides of the insulator layer 16*h* other than one in the negative y-axis direction and has a protruding part 19*d* (not illustrated in FIG. 2) protruding from the three sides. The protruding part 19*d* also protrudes from the both ends of the side in the negative y-axis direction. The coil conductor layer 18*e* is provided along the three sides of the insulator layer 16*i* other than one in the positive x-axis direction and has a protruding part 19*e* (not illustrated in FIG. 2) protruding from the three sides. The protruding part 19*e* also protrudes from the both ends of the side in the positive x-axis direction.

Hereinafter, ends of the coil conductor layers 18 on a clockwise upstream side and ends thereof on a clockwise downstream side in plan view from the positive z-axis direction are referred to as upstream ends and downstream ends, respectively. The number of turns of the coil conductor layers 18 is not limited to ¾ and may be smaller or greater in size, for example, ½ or ⅞.

As illustrated in FIG. 2, the via hole conductors v1-v13 are provided to penetrate the insulator layers 16*a*-16*m* in the z-axis direction, respectively. The via hole conductors v1-v4 penetrating the insulator layers 16*a*-16*d*, respectively, are connected to each other to constitute a via hole conductor. As illustrated in FIG. 3, an end of the via hole conductor v1 in the positive z-axis direction is connected to the outer electrode 14*a*. An end of the via hole conductor v4 in the negative z-axis direction is connected to the upstream end of the coil conductor layer 18*a*.

The via hole conductor v5 penetrating the insulator layer 16*e* in the z-axis direction is connected to the downstream end of the coil conductor layer 18*a* and the upstream end of the coil conductor layer 18*b*. The via hole conductor v6 penetrating the insulator layer 16*f* in the z-axis direction is connected to the downstream end of the coil conductor layer 18*b* and the upstream end of the coil conductor layer 18*c*. The via hole conductor v7 penetrating the insulator layer 16*g* in the z-axis direction is connected to the downstream end of the coil conductor layer 18*c* and the upstream end of the coil conductor layer 18*d*. The via hole conductor v8 penetrating the insulator layer 16*h* in the z-axis direction is connected to the downstream end of the coil conductor layer 18*d* and the upstream end of the coil conductor layer 18*e*.

The via hole conductors v9-v13 penetrating the insulator layers 16*i*-16*m*, respectively, in the z-axis direction are connected to each other to form a via hole conductor. An end of the via hole conductor v9 in the positive z-axis direction is connected to the downstream end of the coil conductor layer 18*e*. As illustrated in FIG. 3, an end of the via hole conductor v13 in the negative z-axis direction is connected to the outer electrode 14*b*.

As illustrated in FIG. 3, in the coil L having the foregoing configuration, the protruding parts 19*a*-19*e* (FIG. 3 illustrates only the protruding part 19*b* in detail) protrude toward the insulator film 20 from the lateral faces S3-S6 of the laminated body 12.

Figure 4:
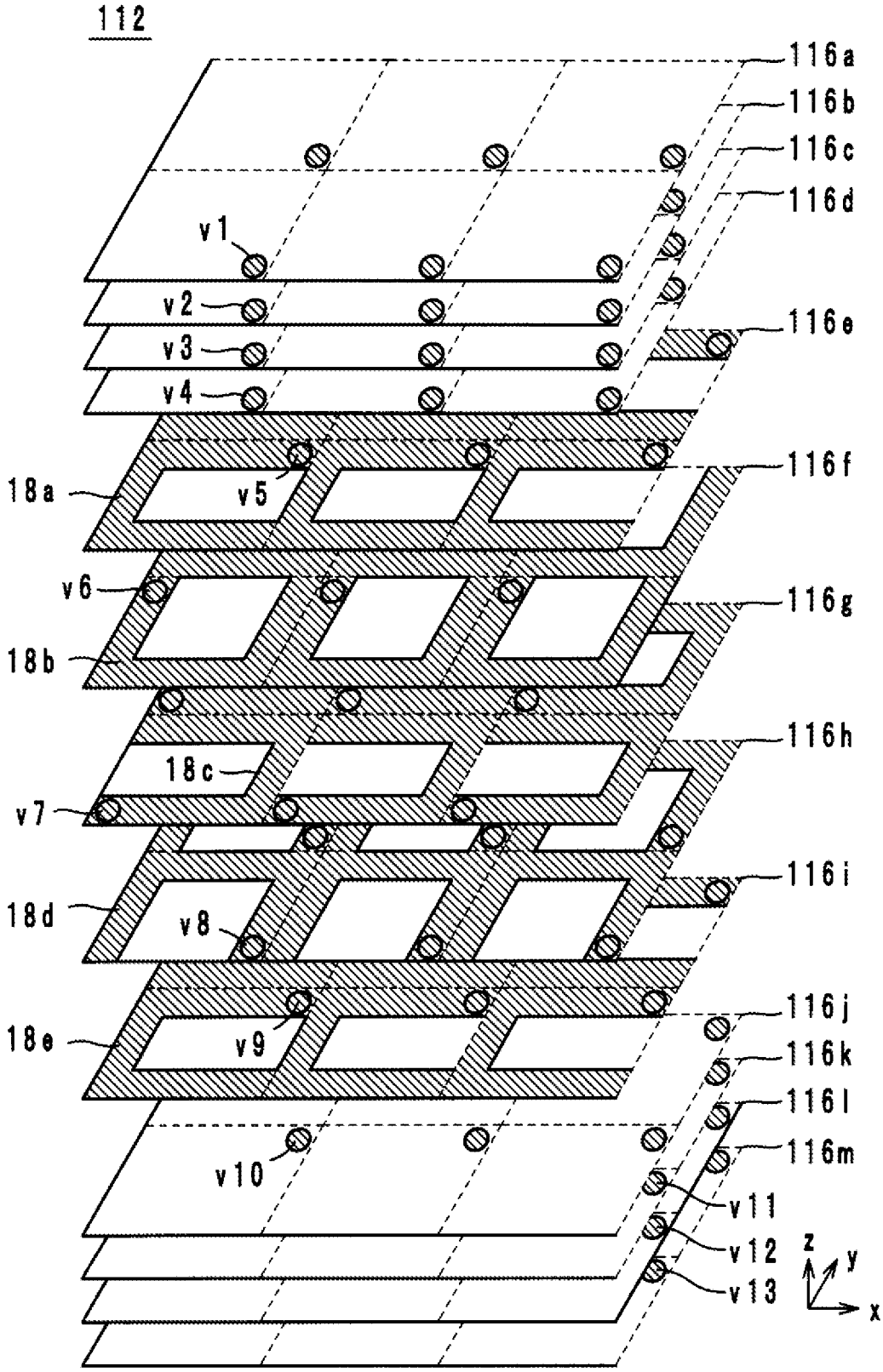
FIG. 4 is an exploded perspective view of a mother laminated body serving as a set of the laminated bodies.
Figure 5:
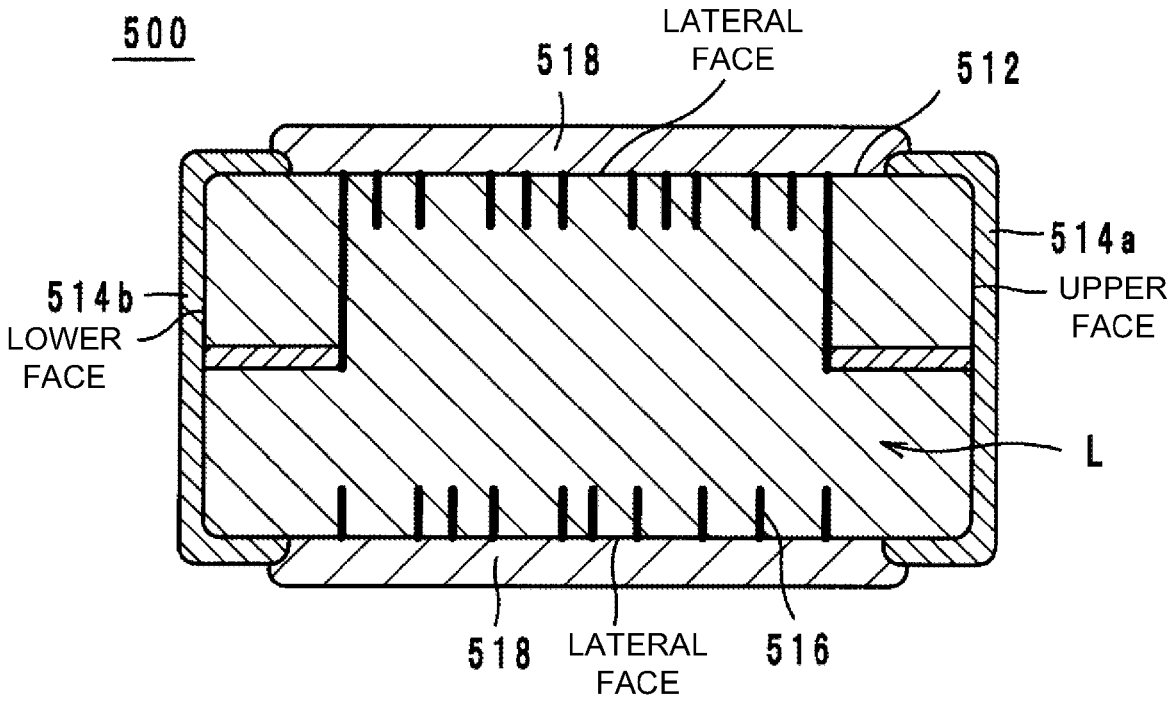
FIG.5 Prior Art
FIG. 5 is a sectional view illustrating a configuration of a multilayer coil disclosed in Japanese Unexamined Patent Application Publication No. 2000-133521.

A method for manufacturing the electronic component 10 according to an exemplary embodiment will now be described below with reference to the accompanying drawings. FIG. 4 is an exploded perspective view of a mother laminated body 112 serving as a set of the laminated bodies 12.

Ceramic green sheets 116 (i.e., 116*a*-116*m*) illustrated in FIG. 4 are prepared first. More specifically, weighed ferric oxide ($Fe_2O_3$), zinc oxide (ZnO), nickel(II) oxide (NiO), and copper(II) oxide (CuO) are put into a ball mill at a predetermined ratio for wet-mixing. The resulting mixture is dried and then pulverized. The resulting power is then calcined for about an hour at about 800° C. The resulting calcined power is wet-pulverized in the ball mill, dried, and then disintegrated to yield ferrite ceramic power.

A binder (such as vinyl acetate and water-soluble acryl), a plasticizer, a humectant, and a dispersant are mixed with the ferrite ceramic power in the ball mill. Thereafter, pressure is lowered for degassing. A sheet of the resulting ceramic slurry is formed on a carrier sheet with the doctor blade method and then dried. In this way, the ceramic green sheets 116 are made.

The via hole conductors v1-v13 are then formed in the respective ceramic green sheets 116. More specifically, the ceramic green sheets 116 are irradiated with a laser beam for formation of via holes. Furthermore, the via holes are filled with paste of a conductive material, such as Ag, Pd, Cu, Au, or alloy thereof, with a method, such as printing. In this way, the via hole conductors v1-v13 are formed.

Paste of a conductive material is then applied onto the ceramic green sheets 116*e*-116*i* with a method, such as screen printing or photolithography, whereby the coil conductor layers 18 (i.e., 18*a*-18*e*) are formed. The conductive material paste can contain, for example, Ag, varnish, and a solvent. The paste having the percentage of the conductive material higher than generally used paste is used here. More specifically, the generally used paste contains about 70 weight percent of the conductive material, whereas the paste used in this embodiment contains about 80 weight percent or higher of the conductive material.

Formation of the coil conductor layers 18 (i.e., 18*a*-18*e*) and filling the via holes with the conductive material paste (e.g., Ag or Ag—Pt) can be carried out in the same step.

The ceramic green sheets 116*a*-116*m* are laminated and press-bonded so that the ceramic green sheets 116*a*-116*m* are arranged in this order from the positive side to the negative side of the z-axis direction, whereby the unfired mother laminated body 112 is yielded. More specifically, the ceramic green sheets 116*a*-116*m* are laminated and roughly press-bonded one by one. The unfired mother laminated body 112 is then press-bonded through hydrostatic pressing under pressure and temperature conditions of about 100 Mpa and about 45° C., respectively.

The unfired mother laminated body 112 is then cut into the individual unfired laminated bodies 12. More specifically, the unfired mother laminated body 112 is cut with a dicer at positions indicated by dotted lines illustrated in FIG. 4. At this point, the coil conductor layers 18 are exposed from the lateral faces S3-S6 of the laminated body 12 but does not protrude therefrom.

Barrel grinding is then performed on surfaces of the laminated body 12 for chamfering. Thereafter, the unfired laminated body 12 undergoes debinding and firing. For example, the debinding is performed in a low-oxygen atmosphere at about 500° C. for about 2 hours, whereas the firing is performed at about 870-900° C. for about 2.5 hours, for example. The ceramic green sheets 116 and the coil conductor layers 18 have different firing shrinkage ratios. More specifically, the ceramic green sheets 116 shrink more than the coil conductor layers 18 during the firing. In particular, since the coil conductor layers 18 are formed of the paste containing more conductive materials than general paste in this embodiment, the shrinkage ratio of the coil conductor layers 18 is smaller than general coil conductor layers. As a result, the coil conductor layers 18 widely protrude from the lateral faces S3-S6 of the fired laminated body 12 as illustrated in FIGS. 2 and 3.

Electrode paste of conductive materials mainly containing Ag is applied onto the upper face S1, the lower face S2, and parts of the lateral faces S3-S6 of the laminated body 12. The applied electrode paste is then baked at about 800° C. for about an hour. In this way, silver electrodes to serve as the outer electrodes 14 (i.e., 14*a* and 14*b*) are formed. Ni plating/Sn plating is then applied onto surfaces of the silver electrodes to serve as the outer electrodes 14, whereby the outer electrodes 14 are formed.

As illustrated in FIG. 3, to form the insulator film 20, a resin, such as an epoxy resin, is applied to parts of the lateral faces S3-S6 of the laminated body 12 without the outer electrodes 14*a* and 14*b*. In this way, the insulator film 20 covers the protruding parts 19. Accordingly, the insulator film 20 prevents a short circuit between the coil L and patterns on a circuit board from occurring. Through the foregoing process, the electronic component 10 completes.

In the foregoing electronic component 10, the size of the coil L included therein can be increased. More specifically, in the electronic component 10, the coil conductor layers 18 protrude from the outer peripheries of the corresponding insulator layers 16 as illustrated in FIG. 2. Since no gap exists between the coil conductor layers 18 and the outer peripheries of the insulator layers 16, the diameter of the coil L can be made larger in the electronic component 10 than in an electronic component having gaps between the coil conductor layers and the outer peripheries of the insulator layers. Thus, the large coil L (i.e., a circuit element) can be formed in the electronic component 10.

When the large coil L can be formed as described above, an inside diameter of the coil L, for example, can be increased. As a result, direct-current (DC) superposition characteristics of the coil L can be improved. With the laminated body 12 formed of a non-magnetic material, the coil L serves as an air-core coil. In this case, a Q value of the coil L increases as the inside diameter of the coil L increases.

When an outside diameter of the coil L is increased with the inside diameter of the coil L being maintained, line width of the coil conductor layers 18 can be increased. In this case, DC resistance of the coil L can be decreased. As a result, the Q value of the coil L increases.

Additionally, the configuration of the electronic component 10 can suppress the insulator film 20 from easily peeling off from the laminated body 12. More specifically, the coil conductor layers 18 have the protruding parts 19 protruding from the lateral faces S3-S6 of the laminated body 12 toward the insulator film 20. In addition to adhesion force between the lateral faces S3-S6 of the laminated body 12 and the insulator film 20, anchor-effect force resulting from protrusion of the protruding parts 19 toward the insulator film 20 is applied between the laminated body 12 and the insulator film 20. Accordingly, in the electronic component 10, the laminated body 12 and the insulator film 20 are firmly adhered by an amount of the anchor-effect force compared with the multilayer coil 500 disclosed in Japanese Unexamined Patent Application Publication No. 2000-133521. As a result, the configuration of the electronic component 10 can suppress the insulator film 20 from easily peeling off from the laminated body 12.

In the electronic component 10, powder of a magnetic material may be added to the insulator film 20. In this case, since a magnetic layer exists on an outer side of the coil L, the coil L serves as a closed-magnetic-circuit coil. As a result, inductance of the coil L can be increased.

The circuit element included in the electronic component 10 is not limited to the coil L. For example, the circuit element may be a capacitor or a filter including a coil and a capacitor.

As described above, the present invention is useful for electronic components. In particular, the present invention is advantageous in that the size of the circuit element formed inside the electronic component can be increased and peeling off of the short-circuit-preventing insulator film from the laminated body can be suppressed.

While preferred embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An electronic component comprising:

a laminated body including a plurality of insulator layers laminated on one another, the laminated body having an upper face and a lower face opposing each other in a lamination direction and lateral faces connecting the upper face to the lower face;

an insulator film on the lateral faces; and a circuit element included in the laminated body, the circuit element having a part protruding from the lateral faces of the laminated body toward the insulator film.

2. The electronic component according to claim 1, wherein the circuit element is a coil.

3. The electronic component according to claim 2, wherein the coil is a helical coil including a plurality of connected conductor layers on the corresponding insulator layers, and wherein the plurality of conductor layers are line conductor layers swirling on the corresponding insulator layers and partially protrude from outer peripheries of the corresponding insulator layers.

4. The electronic component according to claim 1, wherein the insulator layers are formed of ferrite.

5. The electronic component according to claim 2, wherein the insulator layers are formed of ferrite.

6. The electronic component according to claim 3, wherein the insulator layers are formed of ferrite.

7. The electronic component according to claim 1, wherein the insulator film is formed of a material different from that of the insulator layers.

8. The electronic component according to claim 2, wherein the insulator film is formed of a material different from that of the insulator layers.

9. The electronic component according to claim 3, wherein the insulator film is formed of a material different from that of the insulator layers.

10. The electronic component according to claim 4, wherein the insulator film is formed of a material different from that of the insulator layers.

11. The electronic component according to claim 5, wherein the insulator film is formed of a material different from that of the insulator layers.

12. The electronic component according to claim 6, wherein the insulator film is formed of a material different from that of the insulator layers.

13. The electronic component according to claim 1, wherein the circuit element is formed of a conductive paste having a smaller firing shrinking ratio than a firing shrinking ratio of the plurality of insulator layers.

* * * * *